US010443377B2

(12) United States Patent
Lafleur et al.

(10) Patent No.: US 10,443,377 B2
(45) Date of Patent: Oct. 15, 2019

(54) PRESSURE TESTING FOR DOWNHOLE FLUID INJECTION SYSTEMS

(71) Applicant: Halliburton Energy Services, Inc, Houston, TX (US)

(72) Inventors: Louis F. Lafleur, Spring, TX (US); Ralph J. Robert, Spring, TX (US); Clint A. Brown, Magnolia, TX (US); Paul A. Haines, Montgomery, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/506,362

(22) PCT Filed: Mar. 28, 2016

(86) PCT No.: PCT/US2016/024539

§ 371 (c)(1),
(2) Date: Feb. 24, 2017

(87) PCT Pub. No.: WO2017/171713

PCT Pub. Date: Oct. 8, 2017

(65) Prior Publication Data

US 2019/0010805 A1 Jan. 10, 2019

(51) Int. Cl.
*E21B 34/10* (2006.01)
*E21B 49/00* (2006.01)
(Continued)

(52) U.S. Cl.
CPC ..... *E21B 49/008* (2013.01); *E21B 33/122* (2013.01); *E21B 43/16* (2013.01);
(Continued)

(58) Field of Classification Search
CPC ..... E21B 34/063; E21B 34/10; E21B 34/102; E21B 34/103; E21B 49/008; E21B 43/162; F16K 17/40
See application file for complete search history.

(56) References Cited

U.S. PATENT DOCUMENTS 5,240,071 A 8/1993 Shaw et al.
5,271,465 A * 12/1993 Schmidt ..... E21B 43/26 166/297

(Continued)

FOREIGN PATENT DOCUMENTS

WO WO 2016/025048 A1 2/2006

OTHER PUBLICATIONS

International Search Report and the Written Opinion of the International Search Authority, or the Declaration, dated Dec. 22, 2016, PCT/US2016/024539, 18 pages, ISA/KR.

*Primary Examiner* — Kenneth L Thompson

(57) ABSTRACT

A pressure test system for use in downhole fluid injection includes a shear plug assembly disposed along a flow path defined in a sump housing. The sump housing also includes a sump cavity positioned downstream of the shear plug assembly. A shear element of the shear plug assembly secures the shear plug assembly in a first position within the flow path, so that the shear plug assembly blocks fluid flow through the sump housing. Following a pressure test, fluid pressure on the shear plug assembly may be increased until the shear element of the shear plug assembly shears, after which, the pressurized fluid drives the shear plug assembly into the sump cavity, permitting flow to bypass the sump cavity through bypass channels. The bypass channels and other flow paths may be arranged to function as a pressure wave muffler in order to protect pressure sensitive components after shear out.

18 Claims, 9 Drawing Sheets

(51) Int. Cl.

| | |
|---|---|
| ***E21B 43/16*** | (2006.01) |
| ***E21B 33/122*** | (2006.01) |
| ***E21B 47/06*** | (2012.01) |
| *E21B 34/06* | (2006.01) |

(52) U.S. Cl.
CPC ..... *E21B 43/162* (2013.01); *E21B 47/06* (2013.01); *E21B 34/063* (2013.01)

(56) References Cited

U.S. PATENT DOCUMENTS

| | | | | |
|---|---|---|---|---|
| 5,617,921 | A * | 4/1997 | Schmidt | E21B 43/26 166/177.5 |
| 6,082,451 | A | 7/2000 | Giroux et al. | |
| 8,225,859 | B1 * | 7/2012 | Moidel | E21B 37/00 166/99 |
| 8,851,166 | B2 | 10/2014 | Foubister et al. | |
| 8,899,315 | B2 * | 12/2014 | Nguyen | E21B 23/00 166/85.3 |
| 8,967,271 | B2 | 3/2015 | Lamison | |
| 2004/0055741 | A1 | 3/2004 | Pedersen et al. | |
| 2005/0098210 | A1 | 5/2005 | Strattan et al. | |
| 2006/0102338 | A1 | 5/2006 | Angman et al. | |
| 2009/0294123 | A1 | 12/2009 | Mescall et al. | |
| 2014/0318780 | A1 | 10/2014 | Howard | |

* cited by examiner

PRESSURE TESTING FOR DOWNHOLE FLUID INJECTION SYSTEMS

PRIORITY

The present application is a U.S. National Stage patent application of International Patent Application No. PCT/US2016/024539, filed on Mar. 28, 2016, the benefit of which is claimed and the disclosure of which is incorporated herein by reference in its entirety.

TECHNICAL FIELD

The present disclosure relates generally to fluid injection systems in the oil and gas industry and, more specifically, to a pressure integrity test system for installation along a fluid injection line.

BACKGROUND

In the oil and gas industry, chemical management can be important in optimizing fluid production, as well as in minimizing well downtime and expensive intervention. Chemical injection systems may be used to introduce chemicals into the wellbore. Chemical application may include, for example, scale inhibitors, asphaltine inhibitors, emulsions, hydrate inhibitors, defoaming, paraffin, scavengers, corrosion inhibitors, demulsifiers and the like. A typical chemical injection system may include a chemical injection mandrel interconnected along a production pipe string so that the mandrel bore is in fluid communication with the annulus of the pipe string. The mandrel may include one or more injection ports to release chemicals into the mandrel bore. One or more chemicals are supplied to the chemical injection ports via a chemical injection line extending from the surface externally along the outer surface of the pipe string. The chemical injection line extends to the surface where it is coupled to a chemical injection pumping unit. Various other control and communication lines may also extend along the external surface of the pipe string between the chemical injection mandrel and the surface control equipment. The chemical injection mandrel generally also includes a check valve positioned along the flow path to the injection port. The purpose of the check valve is to prevent wellbore fluids, such as production gas, oil or water, from migrating into the chemical injection system via the injection port.

Commonly, prior to injection of chemicals, the chemical injection system is pressure tested to ensure integrity of the chemical injection system. One of the preferred methods of pressure testing a chemical injection system is to incorporate a burst disc, tensile stud, shear pin or similar rupture mechanism at a point along the fluid flow path of the chemical injection system to allow an operator to maintain positive internal pressure within the chemical injection system upstream of the rupture mechanism, permitting the integrity of the chemical injection system to be confirmed. Upon successful pressure testing, the pressure within the chemical injection system is then increased to exceed the rating of the rupture mechanism, forcing the rupture mechanism to fail so as to open up flow through the chemical injection system.

One drawback to conventional pressure testing is that breakage of the rupture mechanism can create debris that can become lodged in downstream flow components, such as check valves or injection ports. As a result, the chemical injection systems may become compromised and may require costly downhole retrieval and re-deployment. Moreover, the yield rating of materials used in the rupture mechanism (typically, metal) may change by temperature fluctuations in the downhole environment. As a result, the rupture mechanism may not yield at the expected fluid pressure because the downhole temperature has altered the yield rating. Therefore, the pressure test system may activate prematurely, thus requiring costly retrieval and re-deployment.

DESCRIPTION OF ILLUSTRATIVE EMBODIMENTS

Generally, illustrative embodiments and related methods are described below as they might be employed in pressure test systems for use with chemical injection systems, the pressure test system generally arranged to minimize debris during pressure testing activities. Such a pressure test system utilizes a shear plug assembly installed along a fluid flow path of the chemical injection system. The shear plug assembly includes a shear plug and a shear flange disposed about the shear plug. The shear plug assembly may have a shear out value determined based upon setting depth, weight of control line fluid, pressure to be applied for integrity testing, and the pressure desired to effectuate shear out. The shear plug assembly is positioned in a sump housing adjacent a sump cavity formed in the housing. The cavity is disposed to capture the shear plug and other debris after shear out, while allowing primary flow along the fluid flow path to bypass the sump cavity, thus minimizing the potential that debris from the shear plug may become lodged in the flow path downstream of the cavity. Moreover, based on well conditions, the shear plug assembly may be selectively retrieved and replaced with another shear plug assembly configured with different shear out values. When pressure testing is completed, the fluid pressure within the chemical injection system may be increased until the shear flange of the shear plug assembly fails, allowing the pressurized fluid to drive the sheared plug into the sump cavity, along with debris from the sheared flange. As a result, the likelihood that debris will progress down the fluid flow path and become lodged downstream, such as in a flow check valve or injection port of the chemical injection system, is minimized. In one or more embodiments, the shear flange of the shear plug assembly may be integrally formed with the shear plug, while in other embodiments the shear flange may be a wafer engaged by the shear plug. In certain embodiments, the sump housing also forms a pressure wave muffler that protects pressure sensitive down flow components (e.g., check valves). Accordingly, the present disclosure provides a alternative to the burst discs, tensile studs, etc., used in conventional systems.

Figure 1:
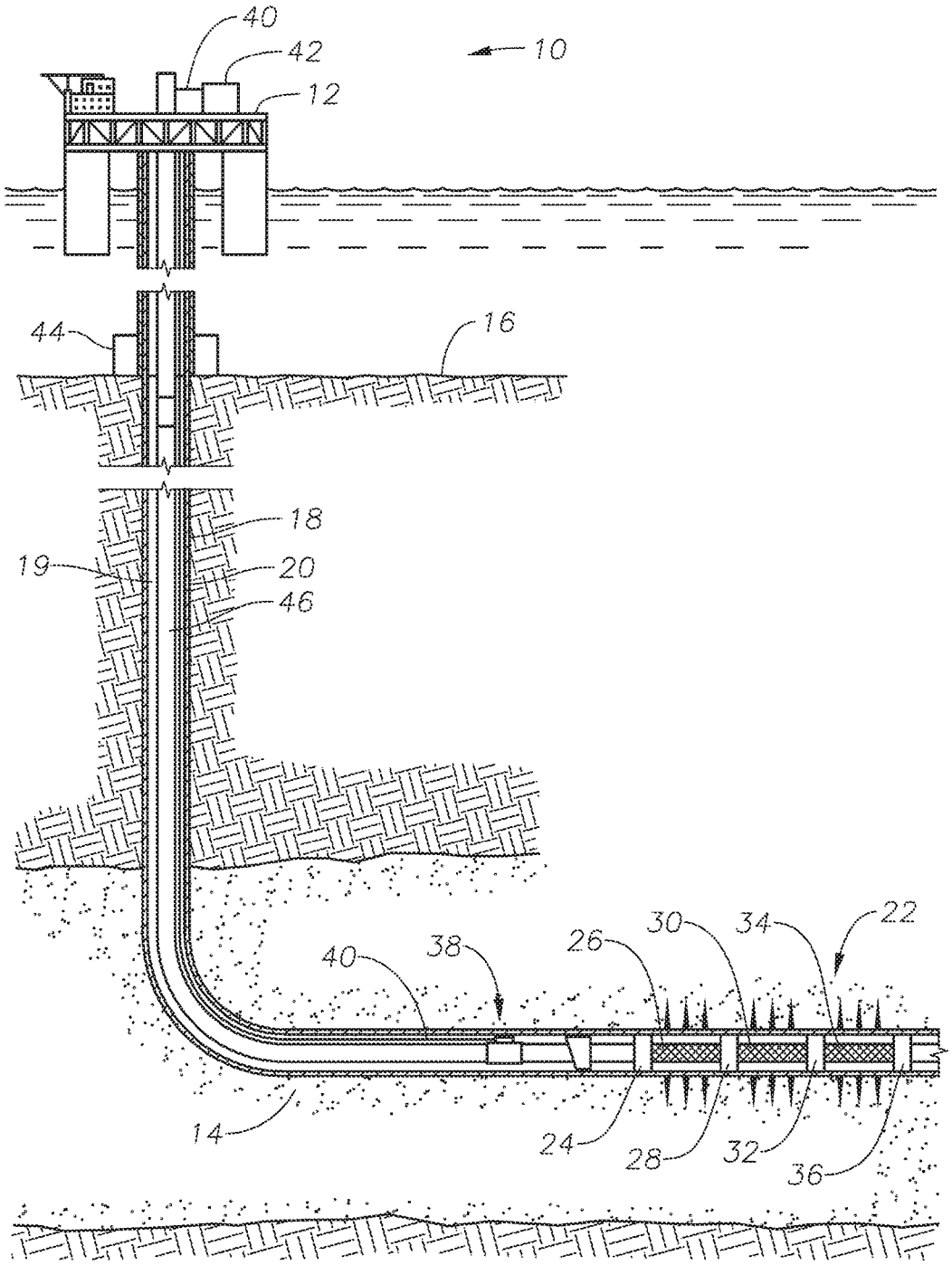
FIG. 1 is an offshore well system that may employ the principles of the present disclosure, according to one or more illustrative embodiments.

Turning to FIG. 1, shown is an elevation view in partial cross-section of a wellbore drilling and production system 10 utilized to produce hydrocarbons from wellbore 18 extending through various earth strata in an oil and gas formation 14 located below the earth's surface 16. Drilling and production system 10 may include a platform 12 from which operations may be carried out. Wellbore 18 may have a casing string 20 cemented therein. Disposed in a portion of wellbore 18 is a completion assembly 22 that may include various components such as a packer 24, sand control screen assembly 26, packer 28, sand control screen assembly 30, packer 32, sand control screen assembly 34 and packer 36. Completion assembly 22 is interconnected within a production pipe string 46 that extends through wellhead 44 to the surface and provides a conduit for the production of formation fluids, such as oil and gas, to platform 12. Disposed along production pipe string 46 so as to be in fluid communication with completion assembly 22 is a chemical injection system 38 having a pressure test system generally comprised of a shear plug assembly and sump housing (See FIGS. 3A and 5A) for preventing clogging of components positioned downflow from the shear plug assembly.

In fluid communication with chemical injection system 38 is a chemical injection line 40 that extends in the annulus 19 between the production pipe string 46 and the casing string 20. Chemical injection line 40 may be used to deliver a treatment fluid (not shown) from a surface installation, depicted as a treatment fluid pump 42, and passes through a wellhead 44 down to chemical injection system 38. Chemical injection line 40 delivers treatment chemicals or other fluids from pump 42 to chemical injection system 38. Illustrative applications of the chemical injection systems described herein include, for example, scale inhibitors, asphaltine inhibitors, emulsions, hydrate inhibitors, defoaming, paraffin, scavengers, corrosion inhibitors, demulsifiers and the like.

As explained in further detail below, even though FIG. 1 depicts the chemical injection system 38 in a horizontal section of the wellbore 18, it should be understood by those skilled in the art that the chemical injection system 38 is specifically designed for use in wellbores having a variety of directional orientations including vertical wellbores, inclined wellbores, slanted wellbores, multilateral wellbores or the like.

Also, even though FIG. 1 depicts an offshore operation, it should be understood by those ordinarily skilled in the art that the chemical injection system 38 of the present disclosure is equally well suited for use in onshore operations. Further, even though FIG. 1 depicts a cased-hole completion, the chemical injection system of the present disclosure is equally well suited for use in open-hole completions. In addition, even though FIG. 1 depicts a single chemical injection installation with a dedicated chemical injection line, it should be understood that the chemical injection system of the present disclosure is equally well suited for use in multipoint chemical injection installations where two or more chemical injection mandrels are installed that share a common chemical injection line and/or valves. Moreover, although described as injecting chemicals treatments into the inner diameter of the tubing string, the chemical injection systems described herein may also be ported or designed to provide chemical treatments to the annulus or other areas along the wellbore.

Figure 2A:
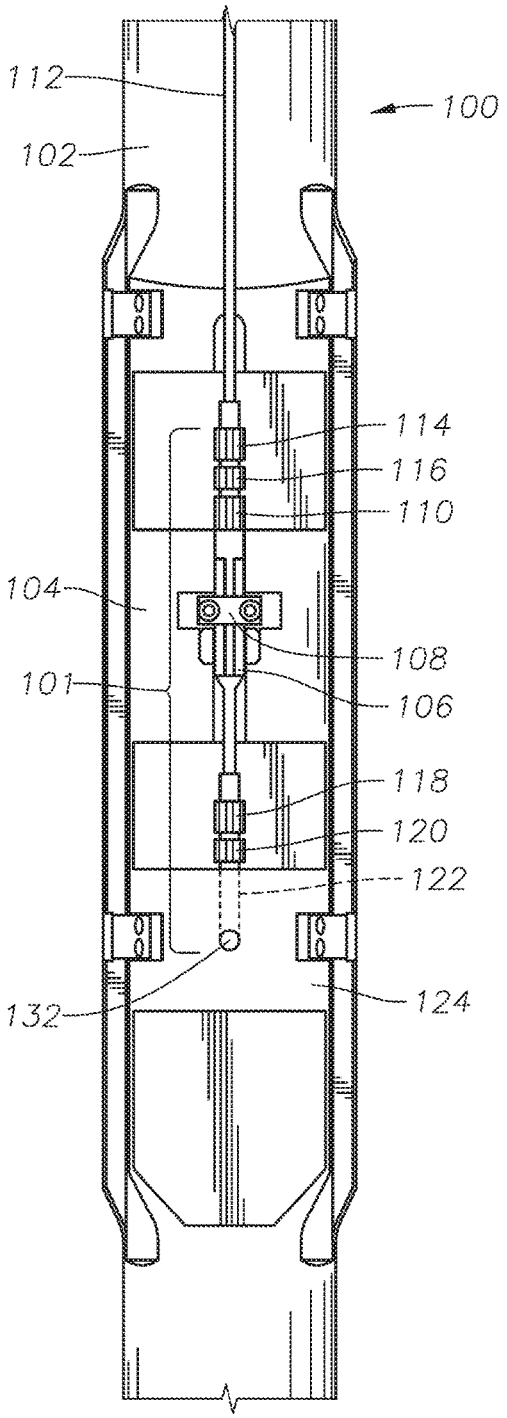
FIGS. 2A-2B depicts a downhole chemical injection system, according to certain illustrative embodiments of the present disclosure.
Figure 2B:
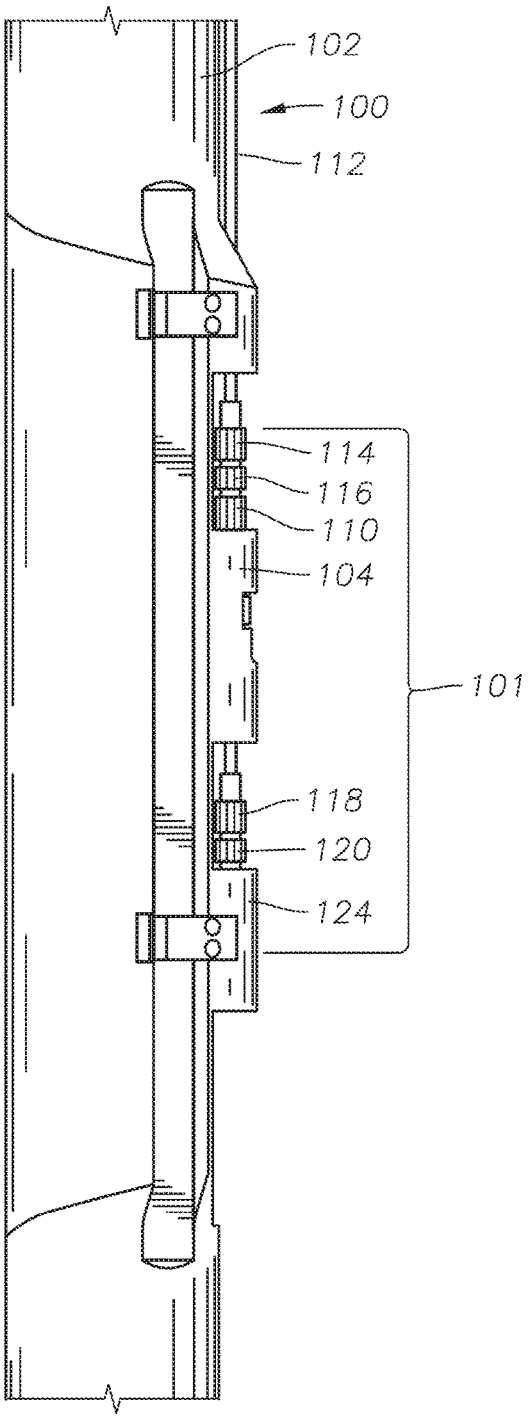

Referring next to FIGS. 2A-2B, the fluid injection system 38 generally described above is illustrated in more detail and generally designated as 100. Downhole chemical injection system 100 includes a generally tubular chemical injection mandrel 102 having an axially extending internal passageway or bore (not shown) that forms a portion of the flow path for the production of formation fluids through production pipe string 46 (see FIG. 1). As used herein the term "axial" refers to a direction that is generally parallel to the central axis of mandrel 102, the term "radial" refers to a direction that extends generally outwardly from and is generally perpendicular to the central axis of mandrel 102 and the term "circumferential" refers to a direction generally perpendicular to the radial direction and the axial direction of mandrel 102. A fluid injection valve assembly 101 is mounted on a support assembly 104 of mandrel 102 and secured thereto by a retainer assembly 108.

Fluid injection valve assembly 101 may include one or more fluid flow control elements 106, such as a check valve. Where fluid control element 106 is a check valve, check valve 106 is generally designed to allow fluid flow in a first direction, such as a downhole direction, and to prevent fluid flow in a second direction, such as an uphole direction. In certain embodiments, multiple redundant check valves 106 may be included in c injection valve assembly 101, such as one hard seat valve and one soft seat valve.

In the illustrated embodiment, fluid injection valve assembly 101 includes a sump housing 110 disposed to be secured to a coupling 114 of chemical injection line 112 by a union 116. Chemical injection line 112 preferably extends to the surface and is coupled to a treatment fluid pump as described above. Union 116 forms a fluid tight connection using, for example, metal-to-metal ferrules or other high pressure fluid tight connection techniques. At its lower end, sump housing 110 includes a coupling 118 that has a fluid tight connection with union 120. Union 120 is in fluid communication with a flow passage 122 that extends through block 124 of mandrel 102 into an injection port 132, which is in fluid communication with the internal passageway (not shown) of mandrel 102 to thereby deliver fluid therein. As will be described in more detail below, the sump housing 110 disposed along the flow path between the chemical injection line 112 and the injection port 132 provides for a fluid injection system 100 that will diminish the likelihood that debris from a shear plug assembly will inhibit flow to and through the injection port 132.

The above example is just one illustrative application of a fluid injection system of the present disclosure. In alternate embodiments, fluid injection valve 101 may be positioned at a variety of other locations within the wellbore. For example, the fluid injection system may be installed in the production string near the mudline to deliver various chemicals such as for hydrate, paraffin and/or asphaltine inhibitors. Alternatively, the fluid injection system may be positioned near the source (e.g., perforations) of scale and/or corrosion inhibitors, or near critical equipment such as safety valves or flow control valves that are desirable for well performance.

Also, they can be positioned near the bubble point where harmful materials are released out of solution. Moreover, the disclosure is not limited to particular types of couplings or fittings used to connect various components that make up a chemical flow path.

Figure 3A:
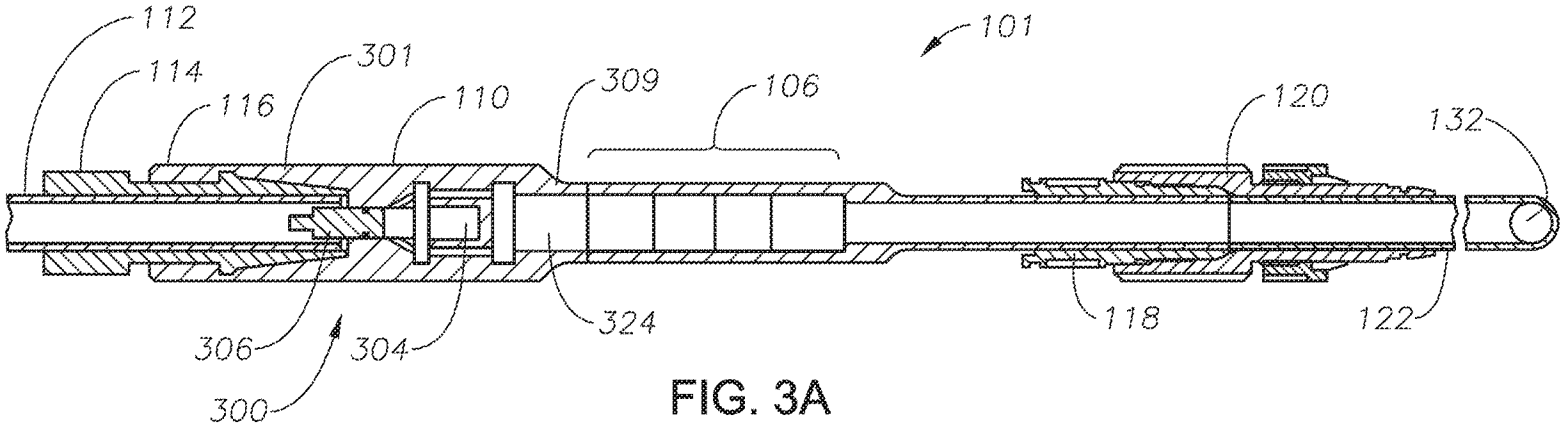
FIG. 3A is a sectional view of a fluid injection valve, according to certain illustrative embodiments of the present disclosure.

FIG. 3A is a cross-sectional side view of a fluid injection valve assembly 101 having a sump housing 110 that forms the pressure test system 300, according to certain illustrative embodiments of the present disclosure. Sump housing 110 generally includes a first end 301 and a second end 309 with a first flow passage 303 formed in the first end 301 and a second flow passage 324 formed in the second end of sump housing 110. In addition to sump housing 110, pressure test system 300 includes a shear plug assembly 302 positioned along a first flow passage 303 formed within sump housing 110. As will be described in more detail below, sump housing 110 also includes a sump cavity 304 formed adjacent first flow passage 303 and positioned to capture shear plug assembly 302 after it has been sheared.

Figure 3C:
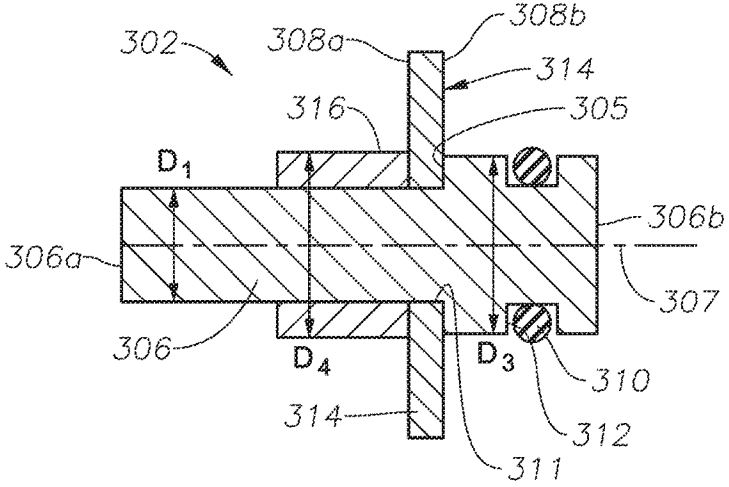
FIGS. 3B and 3C are sectional views of shear plug assemblies, according to alternative embodiments of the present disclosure.
Figure 3B:
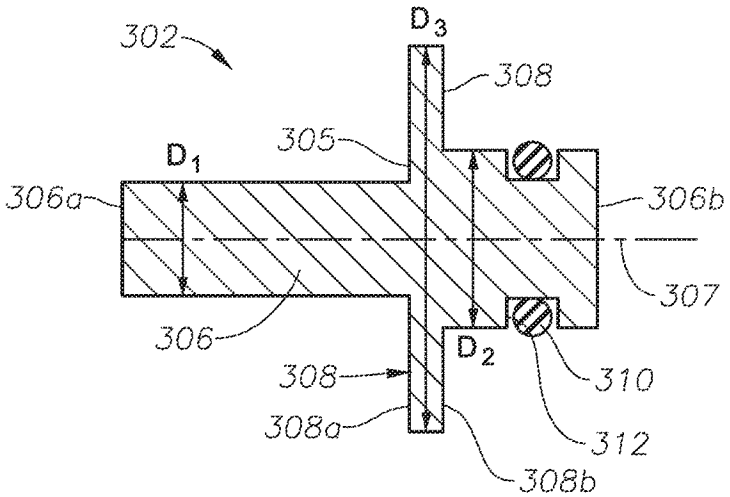

FIGS. 3B and 3C are cross-sectional side views of various embodiments of a shear plug assembly 302 taken along a vertical plane through a central axis 307 of the shear plug assembly 302. Generally, shear plug assembly 302 includes a shear plug body 306 having a first end portion 306*a* and a second end portion 306*b*, with the central axis 307 passing centrally through the first and second end portions 306*a*, 306*b*. The shear plug assembly 302 further includes a radially extending shear element 308. In one or more embodiments, the shear element 308 may be a shear flange 308, while in other embodiments, shear element 308 may have another shape, such as a shear pin or bolt. Likewise, although shear flange 308 is not limited to a particular shape, in one or more embodiments, shear flange 308 may have a substantially flat body of circular cross-sectional shape having a first face 308*a*, a second face 308*b* and an aperture 311 formed therethrough about central axis 307, although alternative cross-sectional shapes are also feasible. As is illustrated in FIG. 3B, in some embodiments, shear element 308 may be integrally formed with shear plug body 306, while in other embodiments, such as illustrated in FIG. 3C, shear element 308 may be separately formed from shear plug body 306. In such case, the end portion 306*a* 306*b* having the smaller diameter may extent through the aperture 311. In one or more embodiments, shear plug body 306 may have a first diameter $D_1$ at the first end portion 306*a* and a second diameter $D_2$ at the second end portion 306*b*. In one embodiment, diameter $D_2$ is of a different dimension than diameter $D_1$ such that a plug shoulder 305 is formed along shear plug body 306 at the intersection of the first and second end portions 306*a*, 306*b*. In one embodiment, diameter $D_2$ is larger than diameter $D_1$.

One or more sealing elements 310 may be provided along plug body 306 for sealing the plug body 306 within sump housing 110 as described below. In one or more embodiments, a seal seat or groove 312 may be provided adjacent the second end portion 306*b* of plug body 306 for receipt of a sealing element 310. Although the disclosure is not limited to a particular sealing arrangement, sealing element 310 may be a circular O-ring. The sealing element 310 is positioned to seal with an inner diameter of first flow passage 303 formed through sump housing 110. In this regard, first flow passage 303 may have a first diameter $DP_1$ and a second diameter $DP_2$ smaller than the first diameter $DP_1$ so as to form a sump housing shoulder 318 at the intersection of the first and second diameters.

Shear element 308 may be positioned to be spaced apart from second end portion 306*b*, such as at plug shoulder 305. In one or more embodiments, sealing element 310 is axially positioned between the second end portion 306*b* and the shear element 308. Where shear element 308 is a shear flange, shear flange 308 may surround the plug body 306 or a substantial portion thereof, and more particularly in this example the shear flange 308 has a circular outer diameter and circumferentially surrounds the plug body 306. The shear flange 308 extends outwardly, radially, from the plug body 306, such that a width $D_3$ (e.g. diameter) of the shear flange 308 is greater than a width $D_1$ or $D_2$ (e.g. diameter) of the plug body 306 immediately above and below the shear flange 308. In the illustrated embodiment, diameter $D_2$ of the plug body 306 at second end portion 306*b* is larger than a diameter $D_1$ of the plug body 306 at first end portion 306*a*.

FIG. 3C illustrates another embodiment of shear plug assembly 302 where shear plug body 306 and shear element 308 are separately formed. Shear plug assembly 302 of FIG. 3C is similar to shear plug assembly 302 of FIG. 3B and, thus, like-numerals refer to like-elements unless otherwise numbered. However, shear element 308 is illustrated as a unique flange or wafer 314 that is mounted on shear plug body 306. In one or more embodiments, wafer 314 may include an aperture 311 sized to permit wafer 314 to fit around first end portion 306*a*. Thus, the diameter of aperture 311 may be slightly larger than the diameter $D_1$ of first end portion 306*a*. In any event, wafer 314 may abut plug shoulder 305 and be secured to shear plug body 306 with a fastener 316. Fastener 316 may be secured to plug body 306 in a variety of ways, such as, for example, a threaded connection, in which case, fastener 316 may be an internally threaded nut disposed to engage an externally threaded portion of plug body 306. In any event, the outer diameter $D_4$ of fastener 316 is preferably no larger than the outer diameter $D_2$ of second end portion 306*b* so as to ensure that fastener 316 will not inhibit plug body 306 from passing along first flow passage 303 upon a shearing event. Thus, diameter $D_4$ is equal to or less than diameter $D_2$. A variety of materials may be used for the plug and nut, such as, for example, metal which is easy to machine and less likely to erode (matched to the well fluids) and generate debris over the life of the well. Shear flange/wafer 314 is made as a unique, separate part, and may be better described as a removable ring (if a circular shape is utilized). Shear wafer/flange 314 may be made of the same material as plug body 306, or may be made of a different material. In certain illustrative embodiments, shear wafer 314 may be formed of ceramic material. In certain applications, ceramic may be a preferred material because its shear rating does not degrade, or weaken, at higher temperatures, such as metals and thermoplastics. As a result, the shear rating of a ceramic flange remains constant in the downhole environment. Moreover, the thickness of the ceramic wafers can be altered to bring about substantial changes in shear values; so, ceramic permits more shear rating flexibility.

Figure 3D:
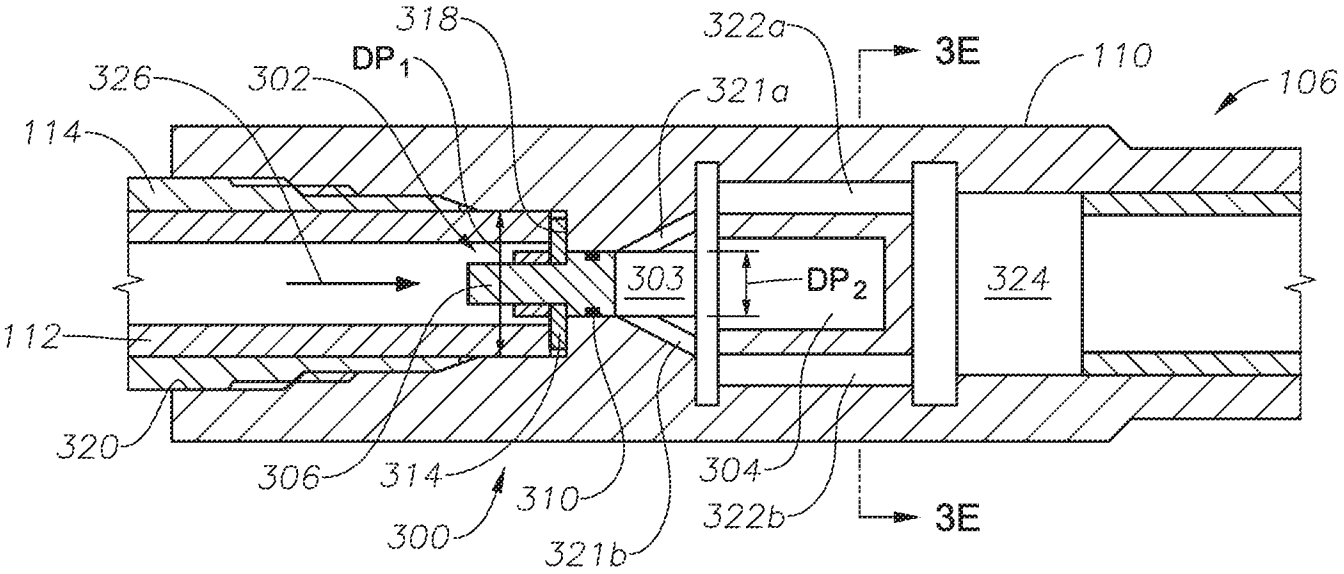
FIGS. 3D, 3F and 3G are exploded views of a pressure test system before shear-out, after shear-out, and during retrieval, respectively, according to certain illustrative embodiments of the present disclosure.
Figure 3E:
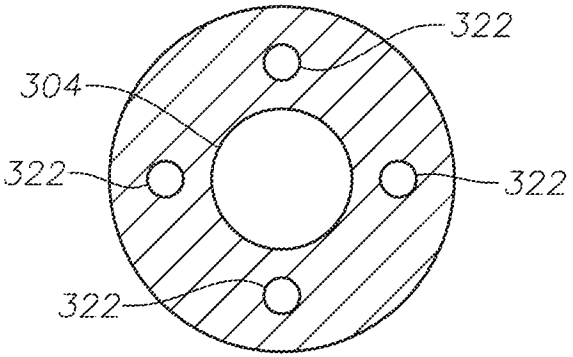
FIG. 3E is a perspective view of a pressure wave muffler along line 3E-3E of FIG. 3D.
Figure 3F:
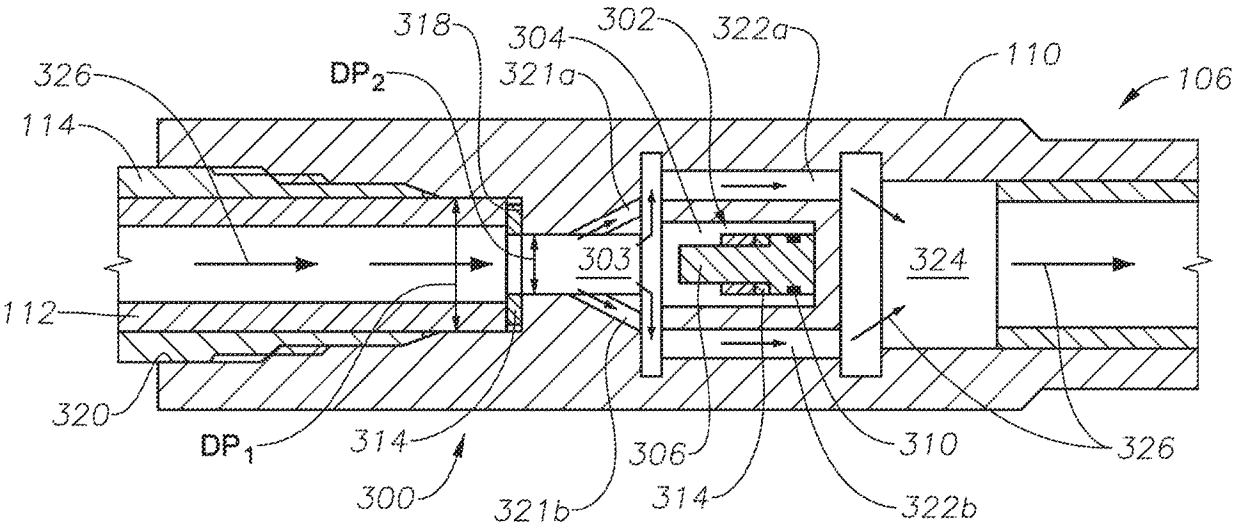

FIGS. 3D and 3F are cross-sectional side views of pressure test system 300 of FIG. 3A that illustrate shear plug assembly 302 and sump housing 110 in more detail, both before and after shear-out, respectively. In one or more embodiments, pressure test system 300 is installed downstream of the injection line union 116 and upstream of fluid control element 106. As a result, system 300 (including the injection line connection and injection line) may be pressurized from the surface, for example. As can be seen, shear plug assembly 302 having a separate shear flange 314 as shown in FIG. 3C is illustrated in this example. Shear plug assembly 302 is positioned in the open end 320 of sump housing 110 so that the second end portion 306*b* of seats within first flow passage 303, and in particular, seal element 310 seals against the walls of first flow passage 303, preventing fluid flow therethrough. Shear flange 314 abuts housing shoulder 318 formed in sump housing 110 adjacent first flow passage 303. It will be appreciated that fluid flow downstream or downhole as the case may be, as generally indicated by arrow 326, may urge shear flange 314 against sump shoulder 318. In one or more embodiments, to further secure shear flange 314 against sump shoulder 318, when union 116 engages coupling 114 (as described above in FIGS. 2A, 2B and 3A), coupling 114 and/or chemical injection line 112 may bear against shear flange 314, as shown in FIG. 3D. Alternatively, some other type of fastener, such as a split ring or threaded ring, may be utilized to secure shear plug assembly 302 within sump housing 110. One benefit to mechanically securing the shear plug assembly 302 in the manner is that wellbore fluid cannot migrate upstream through sump housing 110 into injection line 112 during deployment. Although flow control elements 106 should likewise prevent upstream migration of wellbore fluids though sump housing 110, shear plug assembly 302 blocks communication between the upstream end of sump housing 110 and the downstream end of sump housing 110 as the fluid injection system 100 is deployed in a wellbore. As described above, a sump cavity 304 is formed along first flow passage 303 at a location spaced apart from sump housing shoulder 318. For orientation purposes relative to the indicated direction of flow 326, this location would be spaced apart downstream or downhole of where plug assembly 302 is positioned prior to shear. Sump cavity 304 is a hollow formed in sump housing 110 and shaped to receive plug body 306 via first flow passage 303 after shearing has occurred. At least one, bypass channel 322 is formed in sump housing 110 spaced apart from sump cavity 304 in order to traverse around sump cavity 304, thus permitting fluid communication between first flow passage 303 and the second flow passage 324. One or more ports 321 may fluidically connect bypass channel 322 with first flow passage 303. In the illustrated embodiment, two bypass channel 322*a*, 322*b* are illustrated, as well as two ports 321*a*, 321*b*. Ports 321 are formed along the first flow passage 303 upstream of the sump cavity 304. It will be appreciated that check valve 106 (FIG. 3A) and/or other flow control elements 106 (FIG. 3A) are positioned downstream of second flow passage 324. In addition to serving their primary purposes as set forth above, sump cavity 304 and bypass channels 322 form a pressure wave muffler to protect downstream components such as check valve 106 from pressure waves resulting from shearing of shear plug assembly 302. FIG. 3E is a sectional view of the pressure wave muffler along line 3E-3E of FIG. 3D. In this example, four bypass channels 322 are shown; however, in alternate embodiments, more or less channels 322 may be utilized.

With reference to FIGS. 3D and 3F, when a pressure test is conducted to test system leak integrity of the fluid injection system, fluid pressure is applied via flow 326 to shear plug assembly 302. In particular, the pressure test is conducted against sealing element 310 of plug assembly 302. Before shearing, shear plug assembly 302 is positioned to block fluid communication between injection line 112 and bypass channels 322 (as well as ports 321). In this regard, in one or more embodiments, the plug assembly 302 is disposed in the first flow passage 303 so that the shear element 308 abuts the sump housing shoulder 318. As can be seen in FIG. 3F, after completion of the system integrity check and shear out, the majority of shear plug body 306 is forced into and captured in sump cavity 304. It will be appreciated that continued flow 326 through sump housing 110 will continue to urge sheared plug body 306 into sump cavity 304. In the illustrated embodiment, the remaining portion of shear flange 314 that is not carried with shear plug body 306 remains secured against sump housing shoulder 318, which minimizes the potential for portions of flange 314 from entering first flow passage 303. Remaining debris will be caught in sump cavity 304.

Once shear plug assembly 302 is sheared and shear plug body 306 is captured in sump cavity 304, first flow passage 303 is in fluid communication through ports 321 and bypass channels 322 with second flow passage 324. Moreover, sensitive components downstream from first flow passage 303 are protected from the initial pressure wave created by shearing via the muffler effects of ports 321 and bypass channels 322. As will be understood by those ordinarily skilled in the art having the benefit of this disclosure, the geometry of the ports 321 and bypass channels 322 may be chosen such that the pressure wave is sufficiently reduced or dampened to protect down flow components, while still allowing sufficient flow as desired for fluid injection activities.

Thus, it will be appreciated that FIG. 3D illustrates shear plug assembly 302 in a first position with respect to sump housing 110 and FIG. 3F illustrates shear plug assembly 302 in a second position with respect to sump housing 110. In the first position, shear flange 308 remains intact, while in the second position, shear flange 308 has been sheared as described herein. In the first position, flow into ports 321 (and therefore, into bypass channels 322), is blocked by shear plug assembly 302.

Figure 3G:
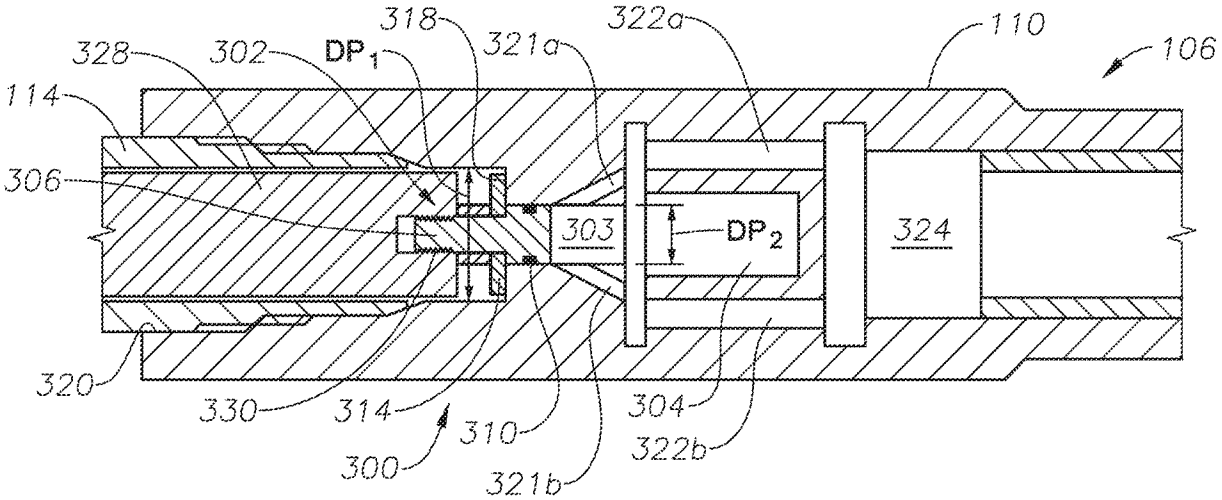

FIG. 3G is cross-sectional side view of pressure test system 300 in which the shear plug assembly 302 is connected to a setting and removal tool 328. The removal tool 328 may be deployed inside sump housing 110 when it is desired to change or otherwise retrieve shear plug assembly 302. In this example, removal tool 328 has an inner thread that engages an outer thread at first end 306*a* of plug body 306, thus forming threaded connection 330. Once removal tool 328 is secured to shear plug assembly 302, shear plug assembly 302 can be pulled from the pressure test system 300. Thereafter, a new shear plug assembly 302, such as one with another shear value, can be installed.

Figure 4B:
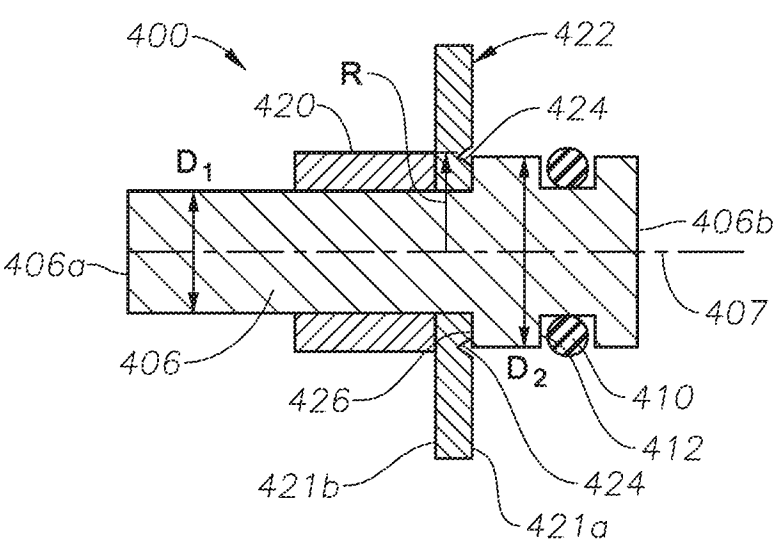
FIGS. 4A and 4B are sectional views of shear plug assemblies having shear notches, according to alternative embodiments of the present disclosure.
Figure 4A:
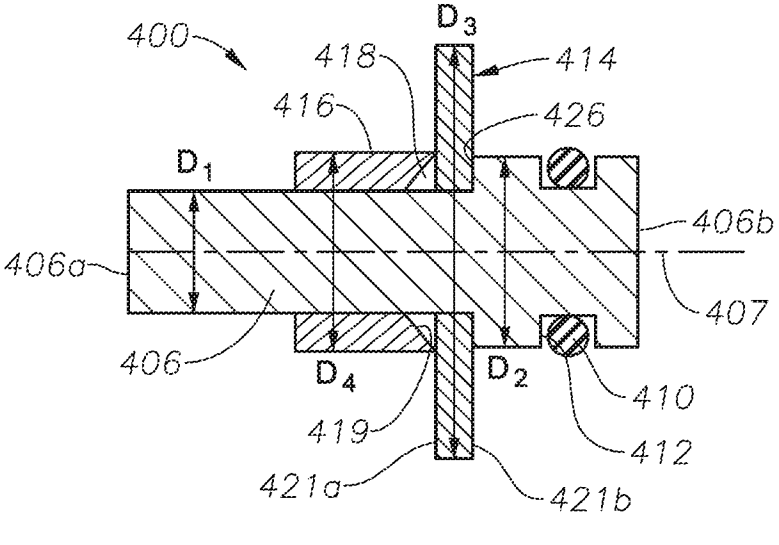

FIG. 4A is across-sectional side view of a shear plug assembly 400, taken along a vertical plane through a central axis 407 of the shear plug assembly 400. Generally, shear plug assembly 400 includes a plug body 406 having a first end 406*a* and a second end 406*b* opposite the first end 406*a* with the central axis 407 passing centrally through the first and second ends 406*a*, 406*b*. The shear plug assembly 400 further includes a shear flange 414 extending radially from plug body 406. In the illustrated embodiment, shear flange 414 is separately formed from plug body 406 and thus is shown as a wafer or washer. Although shear flange 408 is not limited to a particular shape, in one or more embodiments, shear flange 408 may have a circular cross-sectional shape with the central axis 407 passing through the center. Shear plug assembly 400 may include a seal element 410 adjacent second end 406*b*. In one or more embodiments, seal element 410 may be an O-ring seated in a groove 412 at second end portion 406*b*.

In this embodiment, a fastener 416 is positioned around shear plug body 406 and abuts flange 414 to secure flange 414 to shear plug body 406. In one or more embodiments, fastener 416 is a ring 420 having an inner threaded bore, an outer diameter $D_4$ and an end surface 419 abutting the flange 414, wherein a portion of the plug body 406 is threaded for engagement with the threaded bore of the ring 420. In one or more embodiments, shear plug body 406 may have a first diameter $D_1$ at the first end 406*a* and a second diameter $D_2$ at the second end 406*b*. In one embodiment, diameter $D_2$ is of a different dimension than diameter $D_1$ such that a shoulder 426 is formed along shear plug body 406. In one embodiment, diameter $D_2$ is larger than diameter $D_1$. In any event, fastener 416 urges flange 414 against shoulder 426. The outer diameter $D_4$ of fastener 416 is preferably no larger than the outer diameter $D_2$ of second end 406*b* so as to ensure that fastener 416 will not inhibit plug body 406 from passing along first flow passage 303 (FIG. 3D, 3F) upon a shearing event. Thus, diameter $D_4$ is equal to or less than diameter $D_2$. In any event, fastener 416 may include a shear notch 418 formed in the end face 419 of fastener 416 that abuts flange 414. As such, only a portion of face 419 of fastener 416 engages flange 414. In preferred embodiments, notch 418 is formed in face 419 so that only an outer diameter of fastener 416 engages flange 414. Shear notch 418 may improve the accuracy of the shear out device (flange 414) and reduce the debris generated during the shear.

FIG. 4B is a cross-sectional side view of another embodiment of the shear plug assembly 400 illustrated in FIG. 4A, and thus, like-numerals refer to like-elements unless otherwise numbered. In FIG. 4B, however, fastener 416 used to secure flange 422 against shoulder 426 of shear plug body 406 does not have a shear notch, although such a fastener 416 could be utilized in some embodiments. Shear flange 422 (whether integrally formed as part of plug body 406 or separately formed as shown) includes a shear notch 424 formed in at least one face 421*a*, 421*b* of flange 422. Although notch 424 could be formed in either face 421*a*, 421*b* or both, in the illustrated embodiment, notch 424 is formed in face 421*b*. To enhance shearing and minimize debris, the notch 424 may be formed in one or both of the faces 421*a*, 421*b*. Notch 424 is preferably formed at a radius R from the central axis 407 that is approximately the radius of the larger of the first and second diameters $D_1$, $D_2$. Notch 424 is provided to improve the shear accuracy and reduce the debris created during shearing of flange 422. In alternative embodiments, the notches of FIGS. 4A and 4B may be combined as desired. Notably, none of the described notches are limited to a particular shape, but may be selected to promote shearing while minimizing debris as described herein. Moreover, in alternative embodiments, although not shown, shoulders 426 may comprise shear notches also (similar to notices 418). Here, shoulders 426 are formed because the diameter of body 406 is wider at the location of shoulder 426 then the portion of body 406 extending down towards end 406*a*.

The inclusion of the illustrative shear notches may enhance the shear value accuracy of the flange. Moreover, the shear notches increase the potential for a "clean" break of the flange, thus further reducing the potential of debris, and thus, also reduces the potential of the debris being clogged in the tool.

Figure 5A:
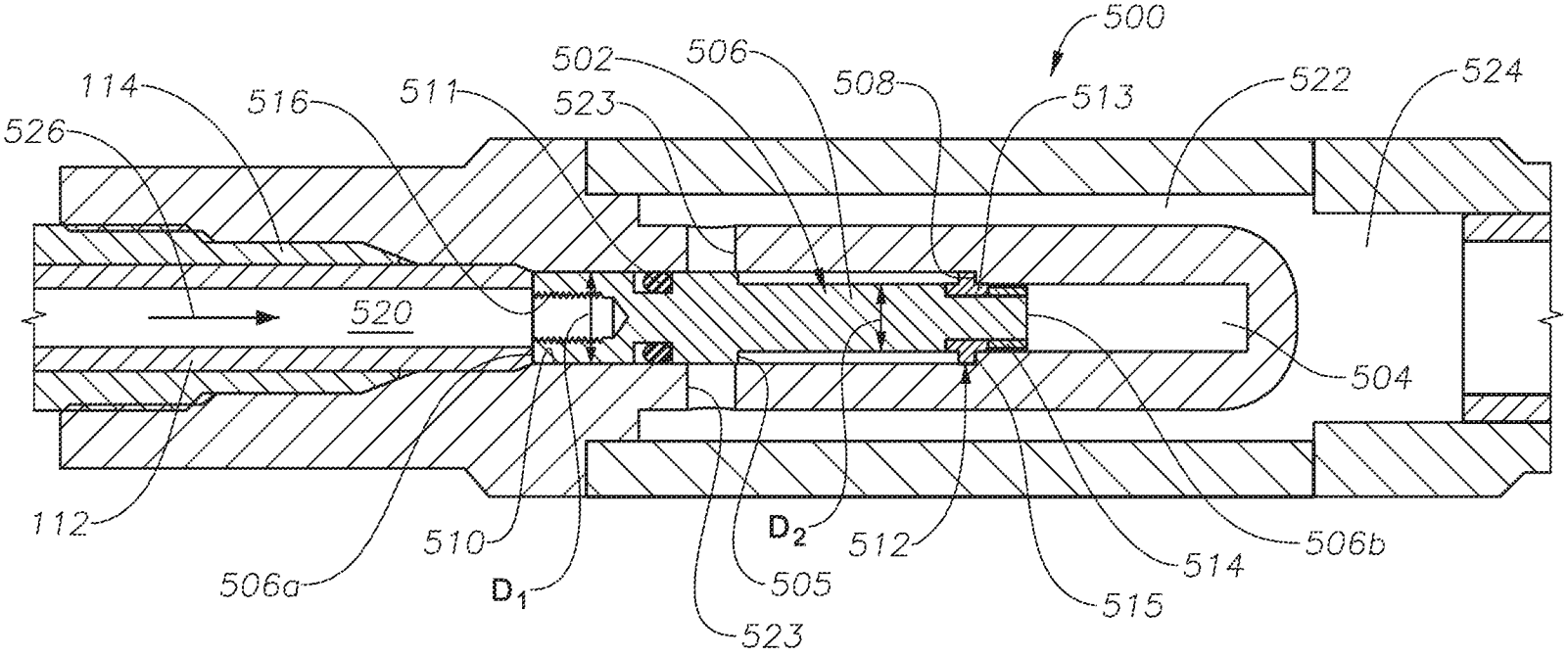
FIGS. 5A and 5B are sectional views of a pressure test system before and after shear-out, respectively, according to an alternative embodiment of the present disclosure.

FIG. 5A is a cross-sectional side view of a pressure test system 500, according to certain alternative embodiments of the present disclosure. In this embodiment, pressure test system 500 includes a shear plug assembly 502 disposed within a sump assembly housing 510. Assembly housing 510 includes a sump cavity 504 formed therein adjacent a first flow passage 520. Assembly housing 510 also includes one or more bypass channels 522 that fluidically connect first flow passage 520 to second flow passage 524. It will be appreciated that bypass channels 522 permit fluid flow 526 to bypass sump cavity 504. A shoulder 508 is formed between sump cavity 504 and first flow passage 520. Bypass channels 522 intersect first flow passage 520 via ports 523 formed in first flow passage 520 upstream of sump cavity 504, which ports 523 are generally blocked when shear plug assembly 502 is in a first position and open to flow 520 when shear plug assembly 502 is in a second position (after shearing of shear element 512 as described below).

Shear plug assembly 502 includes a plug body 506 having ends 506*a* and 506*b*. One or more sealing elements 511 are positioned around body 506 to seal against assembly housing 510 walls of first passage 520. Sealing element 511 may be an O-ring, for example, positioned adjacent first end 506*a*. In this embodiment, shear plug body 506 may have a first diameter $D_1$ at the first end 506*a* and a second diameter $D_2$ at the second end 506*b*. In one embodiment, diameter $D_2$ is of a different dimension than diameter $D_1$ such that a plug shoulder 505 is formed along shear plug body 506. In one embodiment, diameter $D_1$ is larger than diameter $D_2$. Thus, sealing element 511 is positioned between plug shoulder 505 and first end 506*a*. A radially extending shear element 512 is positioned along plug body 506 adjacent second end 506*b*. In one or more embodiments, shear element 512 may be formed of a cylinder 513 with a projection 515 radially extending therefrom. In one or more embodiments, shear element 512 may be a shear flange. A fastener 514 secures shear element 512 to plug body 506. Alternatively, shear element 512 may be integrally formed as part of body 506, eliminating the need for fastener 514.

In one or more embodiments, to further secure shear element 512 against shoulder 508, when union 116 engages coupling 114 (as described above in FIGS. 2A, 2B and 3A), coupling 114 and/or chemical injection line 112 may bear against shear flange 512, as shown in FIG. 5A. Alternatively, some other type of fastener, such as a split ring or threaded ring, may be utilized to secure shear plug assembly 502 within sump assembly housing 510.

Plug body 506 may also include an attachment mechanism 516 for securing shear plug assembly 502 to an installation/retrieval tool (not shown). Although not limited to a particular attachment mechanism 516, in some embodiments, attachment mechanism 516 may be a threaded bore formed in the first end 506*a* of shear plug body 506. Should shear plug assembly 502 need to be changed prior to run-in, a tool, such as a threaded rod, can connect to the attachment mechanism 516 and thereby remove shear plug assembly 502.

Figure 5B:
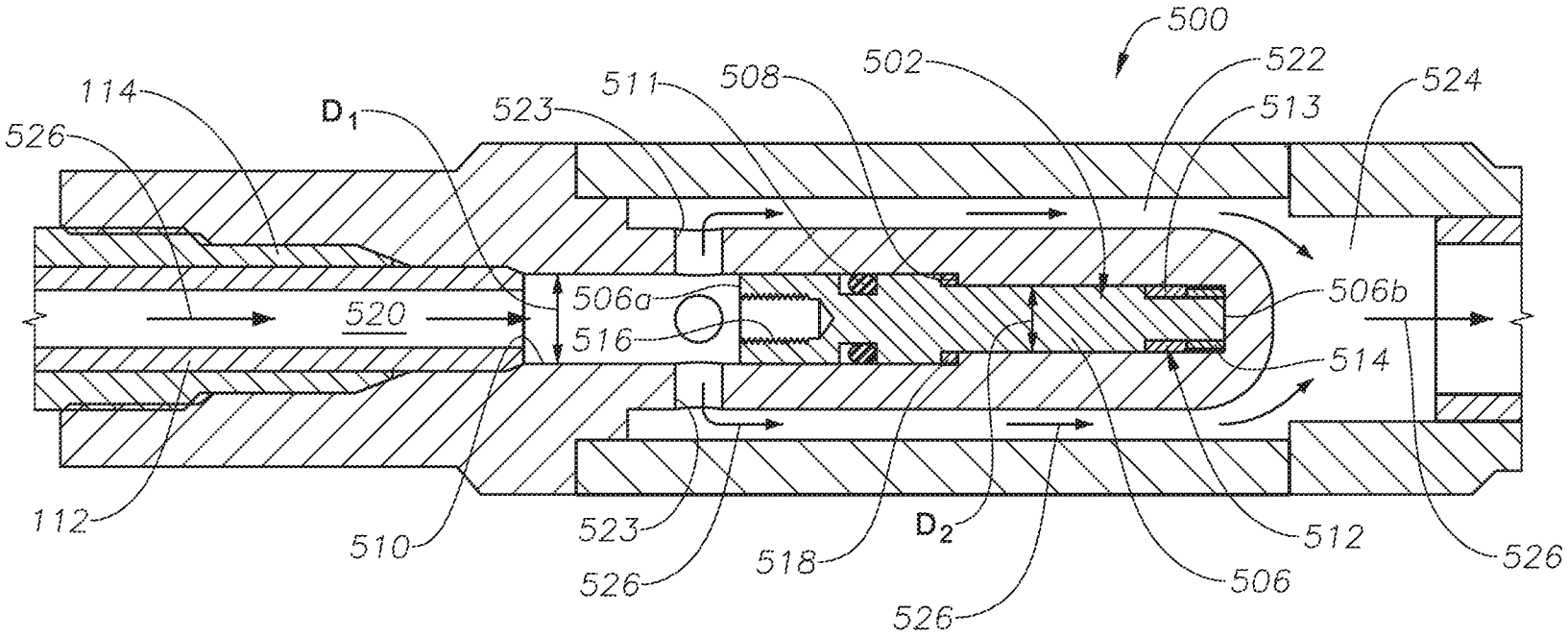

As shown in FIG. 5A, shear plug assembly 502 is disposed in first flow passage 520 adjacent sump cavity 504 so that shear flange 512 abuts shoulder 508, representing a first, unsheared position of pressure test system 500. In the first position, flow into ports 522 (and therefore, into second flow passage 524), is blocked by plug assembly 506. When it is desired to test the leak integrity of a fluid injection system in which pressure test system 500 is installed, pressure to fluid flow 526 within the fluid injection system is increased, applying pressure to seals 510 of plug body 506. As pressure to fluid flow 526 continues to be increased, the pressure eventually rises above the shear rating threshold of shear element 512, thus causing shear element 512 to shear and driving plug body 502 into sump cavity 504. FIG. 5B shows the shear plug assembly 502 in a second position, namely a position after shear plug assembly 502 has been sheared out. In this second position, ports 522 are opened to first passage 520, permitting fluid flow 520 to second passage 524. Shear plug body 506 and a ring portion of shear flange 512 are caught in sump cavity 504. The remaining portion 518 of flange 512 are captured by shoulder 505 of shear plug body 506 against shoulder 508 of sump assembly housing 510. It will be appreciated in the foregoing embodiment that since the shear flange 512 is downstream of ports 522, the risk of flange debris entering ports 522 and second passage 524 is eliminated. Moreover, in this embodiment, ports 522 may also act as a pressure wave muffler to protect pressure-sensitive down flow components from damage due to the initial pressure increased after shearing of flange 512.

In all embodiments of a shear plug assembly described herein, it should be appreciated that the shear plug assembly need only be driven sufficiently into the sump cavity of the sump housing to establish fluid flow through the sump housing from the upstream end to the downstream end of the sump housing. In this regard, in a first position, a portion of the shear plug assembly may already extend into the sump cavity, and shearing simply results in a greater portion of the shear plug assembly being driven into the sump cavity. Thus, it is not necessary that all of the shear plug assembly or shear plug body be driven into the sump cavity, but only a portion sufficient to expose connecting channels and ports, as the case may be, so to establish fluid communication with the second flow passage.

The illustrative embodiments described herein may take a variety of alternate forms. For example, the shear rating based on the shear threshold of the shear flanges may be varied in a number of ways. For example, different materials (metal, ceramic, etc.) may be used that have different shear values. If a separate unique shear flange is used, the flanges can be made from a single wafer or multiple wafers to tailor the shear value as desired.

The illustrative embodiments further provide a number of advantages. The pressure test assemblies can be installed or replaced in the field using hand tools. The shear plug allows the use of metal to metal seals. None metallic seals may only be used to contain pressure during run-in and pressure testing; once the shear out is complete, the non-metallic seals (around the plug body) are no longer needed. The incorporation of the sump cavity in the sump housing allows the sheared plug and flange debris to be directed out of the flow path in certain embodiments, thereby minimizing erosion potential and the potential of debris entering the downhole tool.

The capability to remove the shear plug accommodates last minute changes to well conditions such as, for example, setting depth, control line fluid selection, and desired test and shear pressures. The shear plug may be adapted to many different shear values since a removable shear flange may be used. As a result, tight tolerance on shear values can be achieved without increasing machining tolerances. Moreover, shear wafers may be replaced in the field to match well conditions of an upcoming job.

Figure 6:
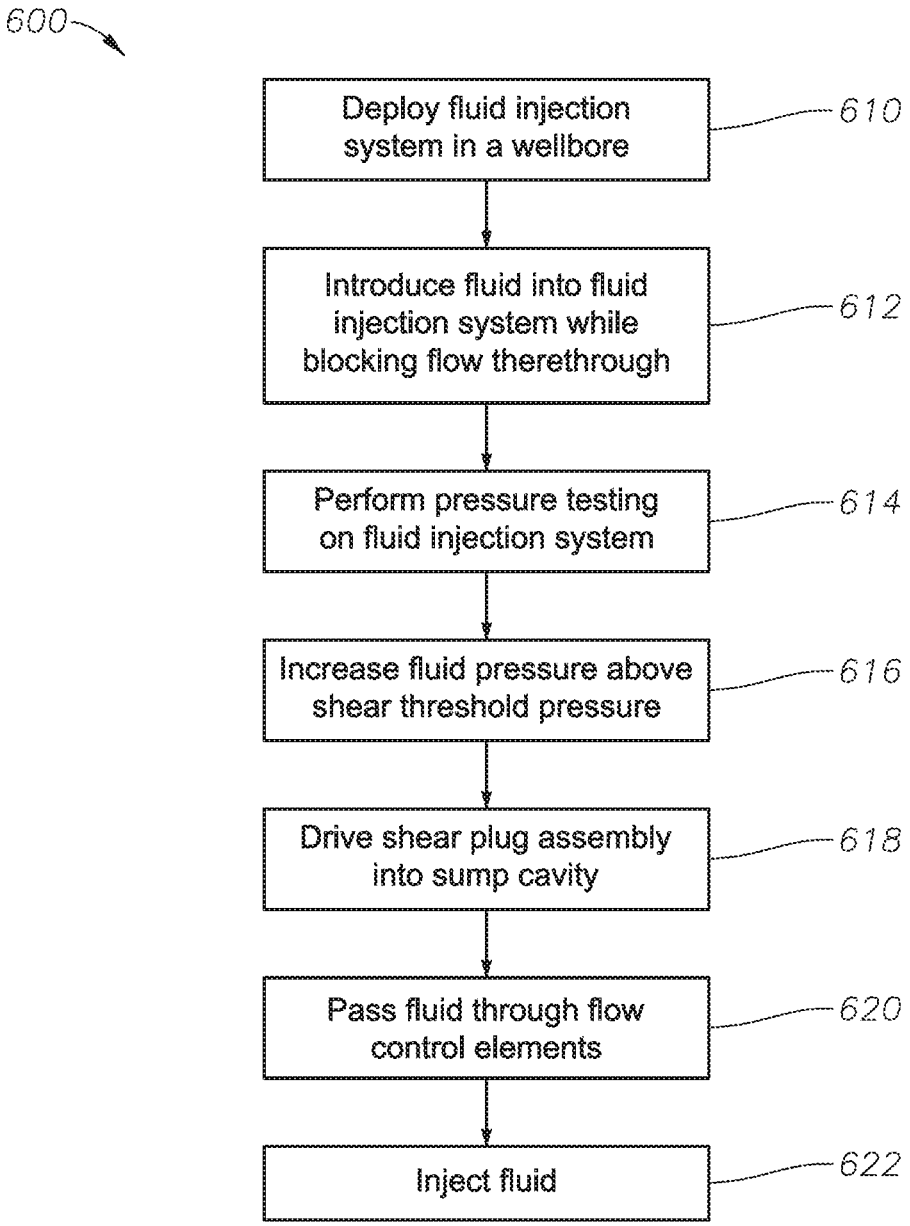
FIG. 6 is a method for introducing chemicals into a wellbore using a pressure test system.

Turning to FIG. 6, a method 600 for injecting a chemical into a wellbore is illustrated. In a first step 610, a fluid injection system, such as system 100 described above, is deployed in a wellbore and positioned at a desired location in the wellbore. The fluid injection system is positioned at the site of the desired chemical injection. The fluid injection may be into the annulus of the wellbore itself or may be for injection into an internal annulus or flowpath defined within various wellbore equipment or pipe strings. Thus, the method is not limited in this regard. In one or more embodiments, the fluid injection system may be deployed in conjunction production string associated with a completion assembly deployed in the wellbore. Thus, in some embodiments, an injection mandrel, such as mandrel 102, may be incorporated in a production pipe string. Supported on the mandrel is a fluid valve assembly, such as fluid valve assembly 101. The fluid valve assembly may include a pressure test system, such as any one of the embodiments described above, and one or more flow control elements 106, such as a check valve. Typically, the check valve would be down stream of the pressure test system 300, i.e., between the pressure test system and the injection port of the chemical injection mandrel. The fluid valve assembly includes a sump housing, in which a sump cavity is formed, and a shear plug assembly having a shear flange dispose about a shear plug body. The shear flange is selected based on an expected set of wellbore conditions, such as depth, pressure, temperature, wellbore fluids, etc. During deployment of the chemical injection system, the shear plug assembly is configured in a first position so as to prevent wellbore fluids from flowing from the wellbore or completion string annulus back upstream through the fluid valve assembly.

Step 610 may further include selecting a shear element based on the environmental conditions of the wellbore at the location where the fluid injection system is positioned. Such conditions may include temperature and pressure as well as the formation fluids and wellbore fluids surrounding the fluid injection system. More particularly, a test pressure $P_{test}$ is selected for testing the fluid injection system. This will be the pressure the fluid injection system is subjected to during testing. A shear element is then selected, wherein the shear element is selected based on its shear threshold so that the shear threshold is greater than the axial force applied by the pressurized fluid to the shear plug assembly when the pressurized fluid is at $P_{test}$. In particular, the shear threshold is that axial force applied the shear plug assembly at which shearing of the shear element will begin.

In a second step 612, fluid is introduced into the fluid injection system while blocking flow through the fluid injection system. The desired treatment fluid may be pumped from the surface to the chemical injection system via the chemical injection line. As will be appreciated, because of the presence of the shear plug assembly in the sump housing in the first position, the shear plug assembly blocks chemical flow through the fluid injection valve assembly.

In step 614, the pressure test is initiated. Specifically, the pressure of the fluid in the fluid injection system is increased to a desired test pressure. This desired test pressure is a first pressure selected to be below a threshold pressure that will result in shearing of the shear element. In other words, the desired test pressure is selected so that the force applied by the fluid to the shear plug assembly is below the threshold shear value of the shear plug assembly. The test pressure may be maintained for a desired period of time and/or cycled as desired and in accordance with the pressure test protocol.

In step 616, upon completion of the pressure test, the pressure of the fluid is increased to a second pressure, namely a pressure that will result in a force applied to shear plug assembly that is above the shear threshold of the shear element. The fluid pressure is increased to a point that the force applied to the shear plug assembly by the pressurized fluid at the second pressure results in a force on the shear plug assembly that is above the shear threshold. As such, the shear flange or shear wafer, as the case may be, shears.

In step 618, the pressurized fluid drives at least a portion of the shear plug body into the sump cavity of the sump housing such that the sump cavity captures a portion of the shear plug assembly, thus establishing fluid communication between an upstream flow path of the sump housing and a downstream flow path of the sump housing. In particular, the flow through the sump housing passes around the sump cavity via bypass channels. The channels, bores and ports may be configured to dampen any pressure wave that might result from the shear. Continue flow through the sump housing may be utilized to retain the sheared plug assembly in the sump cavity. Moreover, a portion of the shear plug body may be used to trap shear debris at a location removed from the fluid flow stream.

In step 620, flow from the sump housing is directed to fluid flow control elements.

Finally, in step 622, flow from the fluid flow control elements is injected at a desired location via one or more injection ports.

Thus, a pressure test system for a wellbore has been described. Embodiments of the pressure test system may generally include a sump housing having first and second flow passages and a bypass channel connecting the first and second flow passages; and a sump cavity adjacent to and in fluid communication with the first flow passage; and a shear plug assembly including a plug body and a shear element radially extending from the plug body. Likewise, a wellbore system for introducing chemicals therein has been described. Embodiments of the wellbore system may generally include a pipe string; a completion assembly in fluid communication with the pipe string; a mandrel interconnected with the pipe string, the mandrel having an injection port; a fluid injection valve assembly comprising pressure test system, a check valve and a flow passage in fluid communication with the injection port; a chemical injection line in fluid communication with the pressure test system; wherein the pressure test system comprises: a sump housing having a first end with a first flow passage, wherein the first flow passage has a first diameter and a second diameter smaller than the first diameter so as to form a sump housing shoulder at the intersection of the first and second diameters; a second flow passage separate from the first flow passage; a bypass channel connecting the first and second flow passages, wherein the bypass channel intersect the first flow passage at a port and the sump cavity is formed along the first flow passage between the port and the second flow passage; and a sump cavity adjacent to and in fluid communication with the first flow passage; and a shear plug assembly including a plug body having a first portion with a first diameter and a second portion with a second diameter, one diameter being larger than the other diameter so as to form a plug shoulder at the intersection of the first and second portions; a radially extending shear flange positioned at the plug shoulder; and a seal element disposed along the plug body portion having the larger diameter.

For any of the foregoing embodiments, the system may include any one of the following elements, alone or in combination with each other:

- The first flow passage has a first diameter and a second diameter smaller than the first diameter so as to form a sump housing shoulder at the intersection of the first and second diameters.
- The bypass channel intersect the first flow passage at a port and the sump cavity is formed along the first flow passage between the port and the second flow passage.
- The plug body is disposed in the first flow passage so that the shear element abuts the sump housing shoulder.
- The sump housing has a first end from which the first flow passage extends and a second end from which the second flow passage extends and the sump cavity is formed in the sump housing between the first flow passage and the second flow passage and the bypass channel extends between the first and second flow passages and is spaced apart from the sump cavity.
- The shear element is a shear flange integrally formed with plug body.
- The shear element is a shear flange characterized by a central axis, the shear flange further comprising a first face and a second face, with a notch formed in one of the faces at a radius from the central axis that is approximately the radius of the larger of the first and second diameters.
- The plug body has a first end portion and a second end portion, wherein the first end portion has a first diameter and the second end portion has a second diameter different than the first diameter so as to form a plug shoulder at the intersection of the first and second end portion, and the shear element is positioned at the shoulder.
- The shear element is a shear flange comprising a substantially flat body with an aperture therethrough, wherein a portion of the plug body extends through the aperture and the shear element abuts the plug shoulder.
- A fastener abutting the flange.
- A fastener abutting the flange, wherein the fastener is a ring having an inner threaded bore, an outer diameter and an end surface abutting the flange, the end surface having a notch formed therein, wherein a portion of the plug body is threaded for engagement with the threaded bore of the ring.
- The shear element is comprised of ceramic material.
- A sealing element disposed along a portion of the plug body having a larger diameter than another portion of the plug body.
- The plug body is disposed in the first flow passage so that the shear flange abuts the sump housing shoulder and the seal element is between the port and the first end of the sump housing.
- A fastener abutting the shear flange, wherein the shear flange is characterized by a central axis, the shear flange further comprising a first surface and a second surface; and wherein the fastener is a ring having an inner threaded bore, an outer diameter and an end surface abutting the flange, wherein a portion of the plug body is threaded for engagement with the threaded bore of the ring.
- The shear flange is comprised of ceramic material.
- A notch is formed in at least the end surface of the fastener or one of the first and second flange surfaces at a radius from the central axis that is approximately the radius of the larger of the first and second diameters of the plug body.

A method for injecting chemicals into a wellbore has been described. The method may generally include positioning a fluid injection system in a wellbore at a desired location; introducing a fluid into the fluid injection system; utilizing a shear plug to block flow into flow ports and through the fluid injection system; applying a first pressure to the fluid to test the integrity of the fluid injection system, wherein the first pressure is below a threshold pressure; increasing the fluid pressure to a second pressure above the threshold pressure in order to initiate shearing of the shear plug, wherein the threshold pressure is the shear pressure of a shear element securing the shear plug in the fluid injection system; and upon shearing, capturing at least a portion of the shear plug in a sump cavity downstream of the flow ports.

For the foregoing embodiments, the method may include any one of the following steps, alone or in combination with each other:

Upon shearing, establishing fluid communication between the flow ports and a check valve; and thereafter, introducing the fluid into the wellbore.

Selecting a shear element based on the environmental conditions of the wellbore at the location where the fluid injection system is positioned.

Pumping the fluid from the surface to the chemical injection system via a chemical injection line.

Increasing fluid pressure from a first pressure to a point that the force applied to the shear plug assembly by the pressurized fluid at a second pressure results in a force on the shear plug assembly that is above a shear threshold for the plug assembly.

Utilizing bypass channels between a first passageway and a second passageway to muffle a pressure wave passing between the first and second passageways.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A pressure test system for a wellbore, the pressure test system comprising:

a sump housing having first and second flow passages and a bypass channel connecting the first and second flow passages, a sump housing shoulder adjacent to the first flow passage and a sump cavity adjacent to and in fluid communication with the first flow passage; and a shear plug assembly including a plug body and a shear element radially extending from the plug body, wherein the plug body is disposed in the first flow passage so that the shear element abuts the sump housing shoulder.

2. The pressure test system of claim 1, wherein first flow passage has a first diameter and a second diameter smaller than the first diameter so as to form a sump housing shoulder at the intersection of the first and second diameters.

3. The pressure test system of claim 1, wherein the bypass channel intersect the first flow passage at a port and the sump cavity is formed along the first flow passage between the port and the second flow passage.

4. The pressure test system of claim 1, wherein the sump housing has a first end from which the first flow passage extends and a second end from which the second flow passage extends and the sump cavity is formed in the sump housing between the first flow passage and the second flow passage and the bypass channel extends between the first and second flow passages and is spaced apart from the sump cavity.

5. The pressure test system of claim 1, wherein the shear element is a shear flange integrally formed with the plug body.

6. The pressure test system of claim 1, wherein the shear element is a shear flange is characterized by a central axis, the shear flange further comprising a first face and a second face, with a notch formed in one of the faces at a radius from the central axis that is approximately the radius of the larger of the first and second diameters.

7. The pressure test system of claim 1, wherein the shear element is comprised of ceramic material.

8. The pressure test system of claim 1, further comprising a sealing element disposed along a portion of the plug body having a larger diameter than another portion of the plug body.

9. The pressure test system of claim 1, wherein the plug body has a first end portion and a second end portion, wherein the first end portion has a first diameter and the second end portion has a second diameter different than the first diameter so as to form a plug shoulder at the intersection of the first and second end portion, and the shear element is positioned at the shoulder.

10. The pressure test system of claim 9, wherein the shear element is a shear flange comprising a substantially flat body with an aperture therethrough, wherein a portion of the plug body extends through the aperture and the shear element abuts the plug shoulder.

11. The pressure test system of claim 10, further comprising a fastener abutting the flange.

12. The pressure test system of claim 11, wherein the fastener is a ring having an inner threaded bore, an outer diameter and an end surface abutting the flange, the end surface having a notch formed therein, wherein a portion of the plug body is threaded for engagement with the threaded bore of the ring.

13. A wellbore system for introducing chemicals therein, the system comprising:

a pipe string;

a completion assembly in fluid communication with the pipe string;

a mandrel interconnected with the pipe string, the mandrel having an injection port;

a fluid injection valve assembly comprising pressure test system, a check valve and a flow passage in fluid communication with the injection port;

a chemical injection line in fluid communication with the pressure test system;

wherein the pressure test system comprises:

a sump housing having a first end with a first flow passage, wherein the first flow passage has a first diameter and a second diameter smaller than the first diameter so as to form a sump housing shoulder at the intersection of the first and second diameters; a second flow passage separate from the first flow passage; a bypass channel connecting the first and second flow passages, wherein the bypass channel intersect the first flow passage at a port and the sump cavity is formed along the first flow passage between the port and the second flow passage; and a sump cavity adjacent to and in fluid communication with the first flow passage; and a shear plug assembly including a plug body having a first portion with a first diameter and a second portion with a second diameter, one diameter being larger than the other diameter so as to form a plug shoulder at the intersection of the first and second portions; a radially extending shear flange positioned at the plug shoulder; and a seal element disposed along the plug body portion having the larger diameter.

14. The wellbore system of claim 13, wherein the plug body is disposed in the first flow passage so that the shear flange abuts the sump housing shoulder and the seal element is between the port and the first end of the sump housing.

15. The wellbore system of claim 14, further comprising a fastener abutting the shear flange; wherein the shear flange is characterized by a central axis, the shear flange further comprising a first surface and a second surface; and wherein the fastener is a ring having an inner threaded bore, an outer diameter and an end surface abutting the flange, wherein a portion of the plug body is threaded for engagement with the threaded bore of the ring.

16. The wellbore system of claim 14, wherein the shear flange is comprised of ceramic material.

17. The wellbore system of claim 15, wherein a notch is formed in at least the end surface of the fastener or one of the first and second flange surfaces at a radius from the central axis that is approximately the radius of the larger of the first and second diameters of the plug body.

18. A method for injecting chemicals into a wellbore, the method comprising:

positioning a fluid injection system in a wellbore at a desired location;

introducing a fluid into the fluid injection system;

utilizing a shear plug to block flow into flow ports and through the fluid injection system;

applying a first pressure to the fluid to test the integrity of the fluid injection system, wherein the first pressure is below a threshold pressure;

increasing the fluid pressure to a second pressure above the threshold pressure in order to initiate shearing of the shear plug, wherein the threshold pressure is the shear pressure of a shear element securing the shear plug in the fluid injection system;

upon shearing, capturing at least a portion of the shear plug in a sump cavity downstream of the flow ports; and upon shearing, establishing fluid communication between the flow ports and a check valve; and thereafter, introducing the fluid into the wellbore.

* * * * *